United States Patent [19]

Canale

[11] 3,981,643

[45] Sept. 21, 1976

[54] ROTARY COMBUSTION ENGINE TWO-PIECE APEX SEAL ARRANGEMENT

[75] Inventor: Raymond P. Canale, Warren, Mich.

[73] Assignee: General Motors Corporation, Detroit, Mich.

[22] Filed: Nov. 29, 1974

[21] Appl. No.: 528,433

[52] U.S. Cl. ..... 418/119; 418/122

[51] Int. Cl.[2] ..... F01C 19/04; F01C 19/08; F04C 27/00

[58] Field of Search ..... 418/113, 119–124

[56] References Cited

UNITED STATES PATENTS

| | | | |
|---|---|---|---|
| 3,194,489 | 7/1965 | Frenzel | 41/122 |
| 3,268,157 | 8/1966 | Frenzel | 418/122 |
| 3,286,699 | 11/1966 | Frenzel | 418/122 |
| 3,286,912 | 11/1966 | Tado | 418/120 |
| 3,400,691 | 9/1968 | Jones | 418/121 |
| 3,448,727 | 6/1969 | Kobayakawa | 418/61 A |
| 3,480,203 | 11/1969 | Koch | 418/119 |
| 3,485,217 | 12/1969 | Irgens | 418/121 |
| 3,556,695 | 1/1971 | Yamamoto | 418/122 |
| 3,894,820 | 7/1975 | Durin | 418/121 |

*Primary Examiner*—John J. Vrablik
*Attorney, Agent, or Firm*—Ronald L. Phillips

[57] ABSTRACT

A rotary combustion engine apex seal arrangement comprising two end-to-end apex seal segments biased by a spring to engage a peripheral wall at their outer sealing surfaces and also to engage side walls at their outer ends thereby leaving a gap only between their inner ends.

1 Claim, 3 Drawing Figures

ROTARY COMBUSTION ENGINE TWO-PIECE APEX SEAL ARRANGEMENT

This invention relates to a rotary combustion engine apex seal arrangement and more particularly to such an arrangement where the seal comprises two end-to-end apex seal segments or pieces with a gap only between their inner ends.

Rotary combustion engine apex seals of the type comprising a rigid bar spanning the width of the peripheral wall on which they slide experience high bending stresses in attempting to conform to the peripheral wall as it grows with heat expansion to an arcuate shape lengthwise of the apex seal. It is also known that these bending stresses can become excessively high where the apex seal passes over a peripheral exhaust port and is then supported only adjacent its two ends. In the development of the apex seals, a primary concern has been to reduce leakage past the apex seal and substantial improvements have been made with a multi-segment apex seal arrangement as compared with a one-piece apex seal. Typically, the multipiece apex seal has a long main segment which spans substantially the width of the peripheral wall and engages the peripheral wall and one or two small end segments which have ramp engagement with the main segment and engage the side walls. However, the main segment remained rigid with the result that high bending stresses were not avoided or relieved while the leakage was reduced. Examples of such multi-segment apex seals are disclosed in U.S. Pat. Nos. 3,556,695, 3,400,691 and 3,712,767. On the other hand, it has been proposed to make the main apex seal segment relatively flexible in bending so as to conform with the changing contour of the peripheral wall with heat expansion as disclosed in U.S. Pat. No. 3,716,313. However, the change in contour is not uniform completely around the peripheral wall and fatigue life of such a seal and its possible protrusion out into a peripheral port becomes a concern. Another approach to maintaining sealing contact with the changing contour of the peripheral wall has been to provide a pair of juxtaposed apex seals at each rotor corner which are each divided into segments with the gaps between the segments arranged so as not to align as disclosed in U.S. Pat. No. 3,253,581. However, in the latter type of apex seal arrangement leakage gaps remain at the opposite ends of the seals and one or more of the many segments could protrude out into a peripheral exhaust port as they pass. There thus remains a need for a very simple yet very comformable low leakage apex seal arrangement that experiences only low bending stresses and can be used with a peripheral intake or exhaust port.

According to the present invention, this need is successfully met by a apex seal arrangement comprising two short apex seal segments which are arranged end-to-end. The two short apex seal segments only need to conform to their half of the peripheral wall as its contour changes with heat expansion and thus experience much lower bending stresses than a full length apex seal. In the case of a peripheral exhaust port the inner ends are located so that they are supported by a bridge across the exhaust port as disclosed in copending U.S. Ser. No. 519,813 filed Nov. 1, 1974 and assigned to the assignee of this invention. Thus, the two apex seal segments will still experience only low bending stresses throughout their travel around the peripheral wall even when used with a peripheral exhaust port and with no possibility that they will protrude out into the port as they pass over. The two short apex seal segments have ramps underneath engaged by a common spring which urges them to engage the peripheral wall at their outer sealing surfaces and also to engage the side walls at their outer ends with the result that there is only a single leakage gap and this is between their inner ends rather than at their outer ends. Since the height of the leakage gap is smaller than the gap for example at the end of a one-segment apex seal, there is substantially reduced leakage in relation thereto which results in more compression pressure, lower fuel consumption, higher power and lower hydrocarbon emissions without a large added manufacturing burden. Furthermore, the center gap provides a further reduction in hydrocarbons because any leakage therethrough is more likely to be burned gas rather than the unburned gas that can leak past one or both of the ends of certain other apex seal arrangements.

An object of the present invention is to provide a new and improved rotary combustion engine apex seal arrangement.

Another object is to provide a new and improved rotary combustion engine apex seal arrangement having good conformability with low bending stresses contributing to long fatigue life and also having a very small leakage gap.

Another object is to provide in a rotary combustion engine a multi-segment apex seal arrangement comprising end-to-end seal segments which are biased to engage a peripheral wall and also side walls leaving only a small gap between their inner ends.

Another object is to provide in a rotary combustion engine an apex seal arrangement comprising two end-to-end seal segments which are spring biased to engage a peripheral wall at their outer sealing surfaces and also to engage side walls at their outer ends leaving only a small gap between their inner ends and wherein the inner ends are located so as to be supported as they travel past a peripheral intake port or exhaust port by a bridge thereacross in the peripheral wall.

These and other objects of the present invention will be more apparent from the following description and drawing in which.

Figure 1:
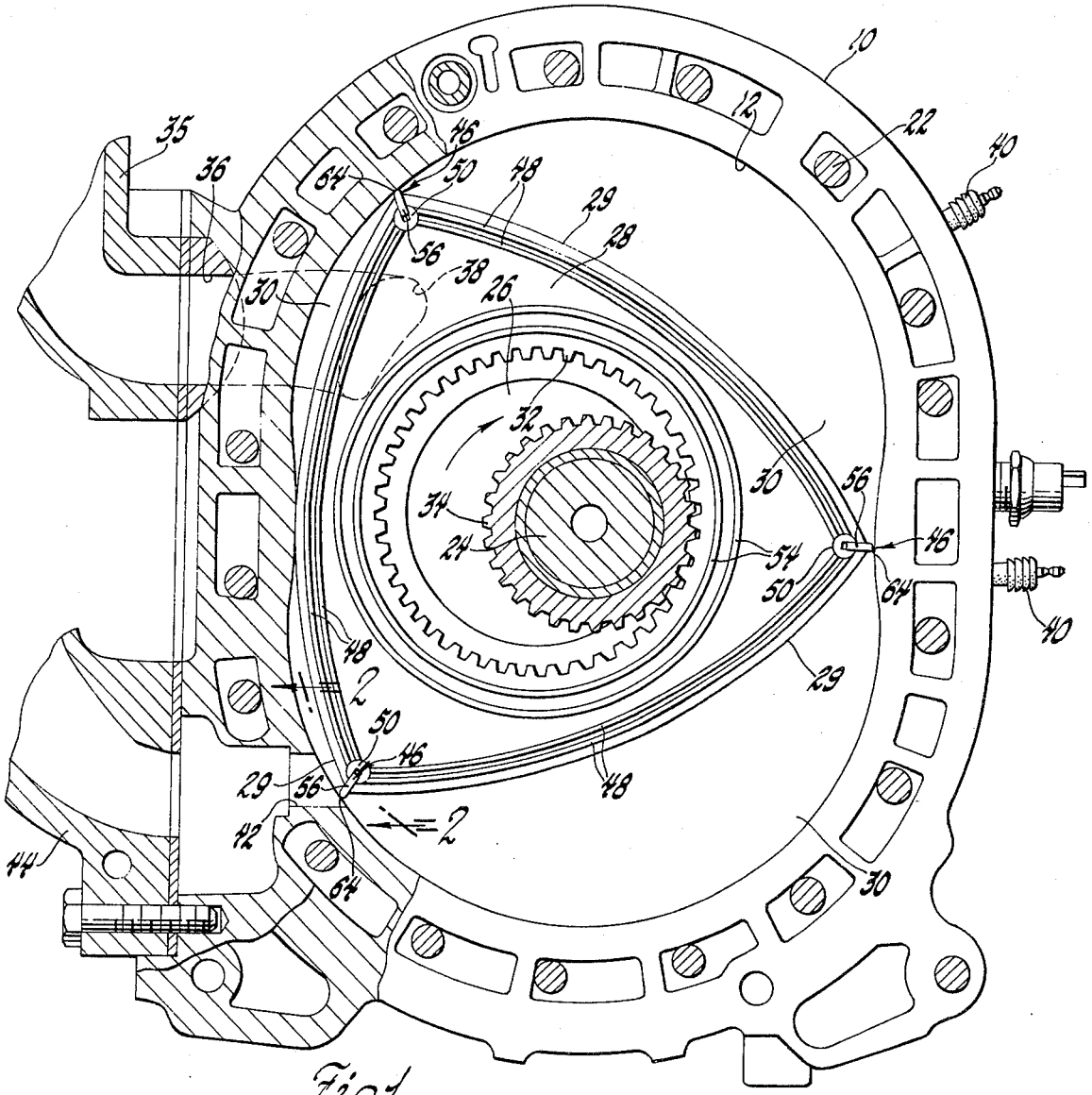
FIG. 1 is a cross-sectional view with parts in section of a rotary combustion engine having an apex seal arrangement according to the present invention.
Figure 2:
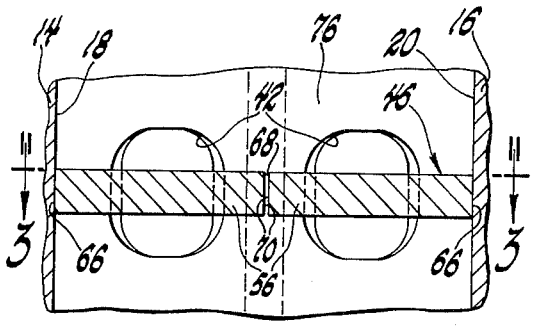
FIG. 2 is an enlarged view taken along the line 2-2 in FIG. 1.
Figure 3:
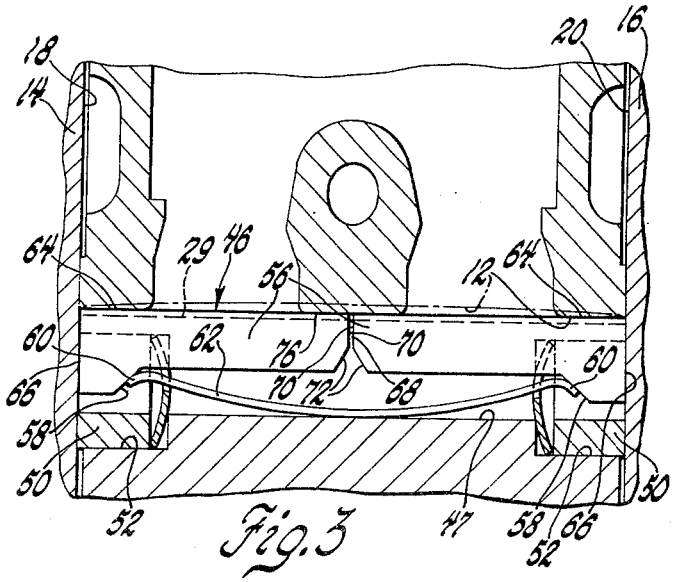
FIG. 3 is an enlarged view taken along the line 3-3 in FIG. 2.

The apex seal arrangement according to the present invention is for use in an internal combustion rotary engine as shown in FIGS. 1, 2 and 3. The engine generally comprises a rotor housing 10 having an inwardly facing inner peripheral wall 12 and a pair of end housings 14 and 16 having parallel, oppositely facing inner side walls 18 and 20 respectively. The housings are secured together by bolts 22 with the inner housing walls 12, 18 and 20 cooperatively providing a cavity. A crankshaft 24 is rotatably supported in the end housings 14 and 16 and has an eccentric 26 on which a rotor 28 is rotatably mounted in the cavity. The inner peripheral wall 12 parallels a two-lobe epitrochoid and the rotor 28 has the general shape of a triangle with faces 29 that cooperate with the inner peripheral wall and also the side walls 18 and 20 to define three variable volume working chambers 30 that are spaced about and move with the rotor as it rotates about the eccentric 26 while the crankshaft 24 turns.

Each of the working chambers 30 is forced to sequentially expand and contract between minimum and maximum volume twice during each rotor revolution in fixed relation to the housing for forcing the rotor 28 to rotate at one-third the speed of the crankshaft 24. This is accomplished by gearing comprising an internal tooth gear 32 which is concentric and integral with one side of the rotor 28. Gear 32 meshes with an external tooth gear 34 which is received with clearance about and is concentric with the crankshaft 24 and is made stationary by being secured to one of the end housings. The rotary gear 32 has one and one-half times the number of teeth as the stationary gear 34 to provide the required speed ratio of 3:1 between the crankshaft and rotor.

A combustible air-fuel mixture from a suitable carburetor arrangement, not shown, mounted on an intake manifold 35 is made available to the working chambers 30 by intake passages 36 in the end housings which terminate with oppositely facing intake ports 38 in the side walls 18 and 20 with the intake ports being located so that they open to the working chambers as they expand. Then as the chambers contract the rotor 28 closes the working chambers to the intake port and the trapped fuel mixture is then compressed and when the rotor faces 29 of the respective chambers are in the vicinity of top-dead-center, the compressed mixture is ignited by a pair of spark plugs 40 which are mounted in the rotor housing 10 with their electrodes exposed through the inner peripheral wall 12 to the passing working chambers. Upon ignition of the mixture in each working chamber the peripheral wall takes the reaction forcing the rotor 28 to continue its forward motion while the gas is expanding. The leading rotor apex of each working chamber eventually traverses an exhaust port 42 in the inner peripheral wall 12 whereby the exhaust products are then exhausted to an exhaust manifold 44.

Sealing of the working chambers 30 for such 4-cycle operation is provided by three apex seal arrangements 46 according to the present invention which are each mounted in an axially extending radially outwardly facing slot 47 at the apexes or corners of the rotor and extend the width thereof as described in more detail later. Three pairs of side seals 48 are mounted in axially outwardly facing slots in each rotor side and extend adjacent the rotor faces between two apex seal arrangements 46 and are spring biased outwardly to engage the opposite side wall. In addition, three cylindrical corner seals 50 are mounted in cylindrical holes 52 in each rotor side with each corner seal providing sealing between adjacent ends of two pairs of side seals and one apex seal as shown in FIGS. 1 and 3 and being spring biased outwardly to engage the opposite side wall as shown in FIG. 3. In addition to the gas seals carried on the rotor 28 there is provided in each rotor side a pair of oil seals 54 that are located radially inwardly of the side walls 48 in axially outwardly facing circular grooves. The oil seals 54 are spring biased outwardly to engage the opposite side wall to prevent the oil supplied for rotor cooling and bearing lubrication from reaching the radially outwardly located gas seals.

Describing now the details of the apex seal arrangement 46 according to the present invention, there are two identical short apex seal segments or bars 56 of generally rectangular shape which are arranged end-to-end in the apex seal slot 47. The short apex seal segments 56 have a ramp 58 on their underneath side which is engaged by a curved end 60 of a leaf spring 62 that seats at its center on the bottom of the apex seal slot 47. The ramps 58 are inclined to the peripheral wall 12 and the respective side walls 18 and 20 so that the segments 56 are urged outward to engage the inner peripheral wall 12 at their rounded outer seal surfaces 64 and also to engage the respective side walls at their flat outer end seal surface 66. As a result, there is only a single leakage gap and this is between their inner ends 70. As can be seen in FIG. 3, the center leakage gap 68 whose height is measured from the face 29 of the rotor adjacent the slot 47 to the inner peripheral wall 12 is much smaller than what the leakage gap would be at the end thereof recognizing that the leakage gap in the latter case has a height measured from the top of the radially inwardly located corner seal 50 to the inner peripheral wall. Since the only leakage gap has thus been substantially reduced there is more compression pressure, lower fuel consumption, higher power and lower hydrocarbon emissions without a large added manufacturing burden as compared with a one-piece or two-piece seal. Furthermore, since the leakage gap 68 is located at the center rather than at the end, there is provided a further reduction in hydrocarbons since any leakage therethrough is more likely to be burned gas rather than the unburned gas that is out at the outer apex seals ends.

Furthermore, as the inner peripheral wall 12 changes contour with heat expansion and grows to a concave shape, for example, as shown by the phantom line in FIG. 3, the two short apex seal segments 56 only need to conform to their half of the changing peripheral wall contour. The segments 56 thus experience much lower bending stresses while providing easier conformability than a full length apex seal, there being formed a chamfer 72 at the lower edge of the inner end 70 of the apex seal segments to provide clearance therebetween as their included angle changes in conforming to the changing contour of the inner peripheral wall.

As shown in FIGS. 2 and 3, the apex seal arrangement 46 according to the present invention can be used with a peripheral exhaust port in addition to side porting without the posibility of protruding outward into such port. This is possible with the use of a bridge 76 in the inner peripheral wall across the center of the port 42 as disclosed in copending U.S. Ser. No. 519,813 filed Nov. 1, 1974 and assigned to the assignee of this invention. With this arrangement the inner ends 70 are supported by the bridge 76 as they pass over the port 42 as best shown in FIG. 2 and still experience only low bending stress throughout their travel around the peripheral wall. It will also be appreciated that the intake porting could be located in the peripheral wall and the exhaust porting located in the side walls or both the intake and exhaust ports could be in the peripheral wall. In either case it is extended that with a peripheral port that the inner ends of the apex seal segments are located so that they are supported by a bridge across the port as they pass over.

The above described embodiment is illustrative of the invention which may be modified within the scope of the appended claims.

I claim:

1. An apex sal arrangement for a rotary combustion engine having an inner peripheral wall and oppositely facing side walls and a rotor between the side walls with apexes that remain adjacent the peripheral wall as the rotor rotates and a peripheral port in the peripheral wall with a bridge across the center, said apex seal arrangement comprising a pair of apex seal segments arranged in a slot in each rotor apex with oppositely facing inner ends and outer ends that face the respective side walls, said segments having a peripheral sealing surface on an outer side and an end sealing surface on their outer end and a ramp on an underneath side inclined relative to the peripheral wall and the adjacent side wall, and a spring arrangeable in the slot having a center portion seating on the bottom of the slot and end portions engaging only said ramps so as to urge said pair of apex seal segments in directions bringing said peripheral sealing surfaces against the peripheral wall and also said end sealing surfaces against the respective side walls whereby a leakage gap is left only between the oppositely facing inner ends of said apex seal segments radially outward of the slot and the inner ends are supported by the bridge as they pass over the peripheral port.

* * * * *

UNITED STATES PATENT AND TRADEMARK OFFICE

CERTIFICATE OF CORRECTION

PATENT NO. : 3,981,643

DATED : September 21, 1976

INVENTOR(S) : Raymond P. Canale

It is certified that error appears in the above-identified patent and that said Letters Patent are hereby corrected as shown below:

Column 3, line 6, "for" should read -- by --.

Column 3, line 60, "walls" should read -- seals --.

Column 4, line 8, "surfaces" should read -- surface --.

Column 4, line 11, before "and" insert the numeral -- 68 --.

Column 4, line 58, "extended" should read -- intended --.

Column 4, line 66, "sal" should read -- seal --.

Signed and Sealed this

Thirtieth Day of November 1976

[SEAL]

*Attest:*

RUTH C. MASON
*Attesting Officer*

C. MARSHALL DANN
*Commissioner of Patents and Trademarks*